US008141613B2

(12) United States Patent
Brutsaert

(10) Patent No.: US 8,141,613 B2
(45) Date of Patent: Mar. 27, 2012

(54) DOUBLE-HINGED AWNING ARM

(75) Inventor: Louis Brutsaert, Menen (BE)

(73) Assignee: Brustor, Naamloze Vennootschap, Wervik-Geluwe (BE)

( * ) Notice: Subject to any disclaimer, the term of this patent is extended or adjusted under 35 U.S.C. 154(b) by 111 days.

(21) Appl. No.: 12/549,045

(22) Filed: Aug. 27, 2009

(65) Prior Publication Data

US 2010/0051207 A1 Mar. 4, 2010

(30) Foreign Application Priority Data

Aug. 28, 2008 (BE) ..... 2008/0475

(51) Int. Cl.
*E04F 10/06* (2006.01)

(52) U.S. Cl. ..... 160/70; 160/77; 160/79; 160/22; 160/81; 160/45

(58) Field of Classification Search ..... 160/22, 160/45, 59, 66–70, 72–73, 77–79, 81; 16/371, 16/363; 403/53, 55, 57, 58, 111–113, 119–121
See application file for complete search history.

(56) References Cited

U.S. PATENT DOCUMENTS

| | | | | | |
|---|---|---|---|---|---|
| 272,339 | A | * | 2/1883 | Shuman | 464/136 |
| 1,386,860 | A | * | 8/1921 | Goudie | 160/70 |
| 1,538,781 | A | * | 5/1925 | Baehr | 296/147 |
| 1,993,183 | A | * | 3/1935 | Schane | 403/111 |
| 2,027,499 | A | * | 1/1936 | Tully | 280/492 |
| 2,038,259 | A | * | 4/1936 | Anton | 160/70 |
| 2,436,336 | A | * | 2/1948 | Slater | 403/58 |
| 2,551,136 | A | * | 5/1951 | Keltner | 280/492 |
| 2,773,368 | A | * | 12/1956 | Slaght | 464/130 |
| 3,820,192 | A | * | 6/1974 | Ogasawara | 16/334 |
| 4,566,516 | A | * | 1/1986 | Lohausen | 160/22 |
| 4,590,642 | A | * | 5/1986 | Hesener | 16/241 |
| 4,615,637 | A | * | 10/1986 | Pelischek | 403/85 |
| 5,218,880 | A | * | 6/1993 | Mizutani | 74/473.36 |
| 5,324,235 | A | * | 6/1994 | Tomii et al. | 464/136 |
| 5,348,414 | A | * | 9/1994 | Dziuk et al. | 403/90 |
| 5,659,361 | A | * | 8/1997 | Jin | 348/375 |
| 5,832,978 | A | * | 11/1998 | Kroner | 160/79 |
| 5,836,210 | A | * | 11/1998 | Lohausen | 74/483 K |
| 5,873,640 | A | * | 2/1999 | Oertley | 305/138 |
| 6,021,836 | A | * | 2/2000 | Schmitz | 160/70 |

(Continued)

FOREIGN PATENT DOCUMENTS

EP 125727 A1 * 11/1984

*Primary Examiner* — Katherine w Mitchell
*Assistant Examiner* — Johnnie A Shablack
(74) *Attorney, Agent, or Firm* — Bacon & Thomas PLLC

(57) ABSTRACT

Awning of the type which is provided with a roll-up shaft (3) on which is wound a cloth (4) which is fixed with one edge to a front lath (5) which is supported by means of two or more articulated arms (6), every articulated arm (6) consisting of at least two arm parts (9-10) which are hinge (12)—mounted to one another so as to be able to fold together the articulated arm (6) around a pivot (16) and to open it. The hinge (12) is a multiple hinge which not only allows for a rotation around the above-mentioned first pivot (16), but which at least also allows for a rotation around a second pivot (17) which is directed crosswise or mainly crosswise to the first pivot (16).

14 Claims, 9 Drawing Sheets

U.S. PATENT DOCUMENTS 6,363,664 B1 * 4/2002 Brutsaert ..... 52/74
6,581,664 B2 * 6/2003 Kroner et al. ..... 160/70
6,732,018 B2 * 5/2004 Osinga ..... 700/275
6,820,673 B2 * 11/2004 Wessels ..... 160/70
6,874,558 B2 * 4/2005 Mester et al. ..... 160/22
6,904,826 B2 * 6/2005 Hesener ..... 74/483 R
7,117,565 B2 * 10/2006 Brutsaert ..... 16/386
7,179,009 B2 * 2/2007 Stimpfl et al. ..... 403/57
7,369,672 B2 * 5/2008 Hirschhorn ..... 381/333
7,371,180 B2 * 5/2008 Cymbal et al. ..... 464/119
7,451,797 B2 * 11/2008 Forns ..... 160/79
7,596,831 B2 * 10/2009 Faubert et al. ..... 16/334
7,784,662 B2 * 8/2010 Wales et al. ..... 227/175.1
2005/0257344 A1 * 11/2005 Allen ..... 16/371
2006/0151125 A1 * 7/2006 Llagostera Forns ..... 160/79
2007/0193700 A1 * 8/2007 Ornelas et al. ..... 160/70
2008/0085149 A1 * 4/2008 Gamache ..... 403/54
2009/0041535 A1 * 2/2009 Hu ..... 403/57
2009/0106940 A1 * 4/2009 Greenbank ..... 16/367
2009/0223021 A1 * 9/2009 Endo et al. ..... 16/371
2010/0051207 A1 * 3/2010 Brutsaert ..... 160/72

* cited by examiner

DOUBLE-HINGED AWNING ARM

FIELD OF THE INVENTION

The present invention concerns an improved awning.

RELATED ART

In particular, the invention concerns an awning of the type which is provided with a roll-up shaft on which is wound a cloth which is fixed with one edge to a front which is supported by means of two or more articulated arms which are each formed of at least two arm parts which are hinge-mounted to one another, such that the articulated arm can be folded together round a pivot and can be opened.

Traditionally, springs are provided in the articulated arms which tend to push open the articulated arms into their stretched position and consequently tend to push the front lath away from the roll-up shaft, as a result of which the cloth stays constantly stretched when being unrolled.

When unrolled, the cloth of the awning always shows a certain slope so as to obtain a slope for the drainage of rain water.

Because of this slope, the free height under the front lath will be smaller than the height at which the roll-up shaft is suspended or fixed, so that consequently, the roll-up shaft will have to be suspended at a height which is larger than the free height one wishes to obtain under the front lath when the awning has been completely unrolled.

However, a problem hereby is that there is not always sufficient clearance available so as to suspend the roll-up shaft at a sufficient height.

This is for example the case with awnings which are attached to campers or with awnings which are attached under eaves or the like.

In this case, there is often no sufficient free height under the awning cloth to make it possible, for example, to entirely open an outward opening door without making contact with the awning cloth or, in the case of a camper with a lateral slide-out room, to slide out said room sufficiently far without being hindered by the presence of the sloping awning cloth.

The present invention aims to remedy one or several of the above-mentioned and other disadvantages.

BRIEF SUMMARY OF THE INVENTION

To this end, the invention concerns an improved awning of the above-mentioned type with two or several articulated arms whereby the hinge of each articulated arm is a multiple hinge which not only allows for a rotation around the above-mentioned pivot to fold together and open the articulated arms, but which also at least allows for a rotation around a second pivot which is directed mainly crosswise to the first pivot.

Such a multiple hinge makes it possible for example for the arm parts, which are fixed to the front lath, to bend down at an angle in relation to the other arm parts with which the articulated arms are fixed to the awning or to a wall on which the awning is fixed.

Thus, the awning cloth will show a downward dip at the connecting line between the hinges of the articulated arms, and the stretched awning cloth will show two flat parts that are bent in relation to one another, namely a first slanting part between the roll-up shaft and the dip and a stronger sloping part between the dip and the front lath.

This offers the advantage that, for one and the same free height under the clearance lath, there will be more free height available under the awning cloth, such that, in the case of the present invention, there will be more clearance available under the awning cloth so as to make it possible to entirely open an outward opening door or to entirely slide out a slide-out room without being hindered by the awning cloth, even when the available height for fixing the roll-up shaft is limited, as is often the case.

The above-mentioned hinges of the articulated arms are preferably provided with a guide which is such that, when opening the articulated arms, as a result of the awning cloth being unrolled, the front arm will automatically move at a set angle around the second pivot and, when rolling up the cloth, it will turn back in the opposite sense at the same angle.

BRIEF DESCRIPTION OF THE DRAWINGS

In order to better explain the characteristics of the invention, the following preferred embodiment of an improved awning according to the invention is described by way of example only without being limitative in any way, with reference to the accompanying drawings, in which:

FIGS. 3 to 4 show the part of FIG. 2 in different successive positions when rolling up the awning from FIG. 1;

DETAILED DESCRIPTION OF PREFERRED EMBODIMENTS OF THE INVENTION

Figure 1:
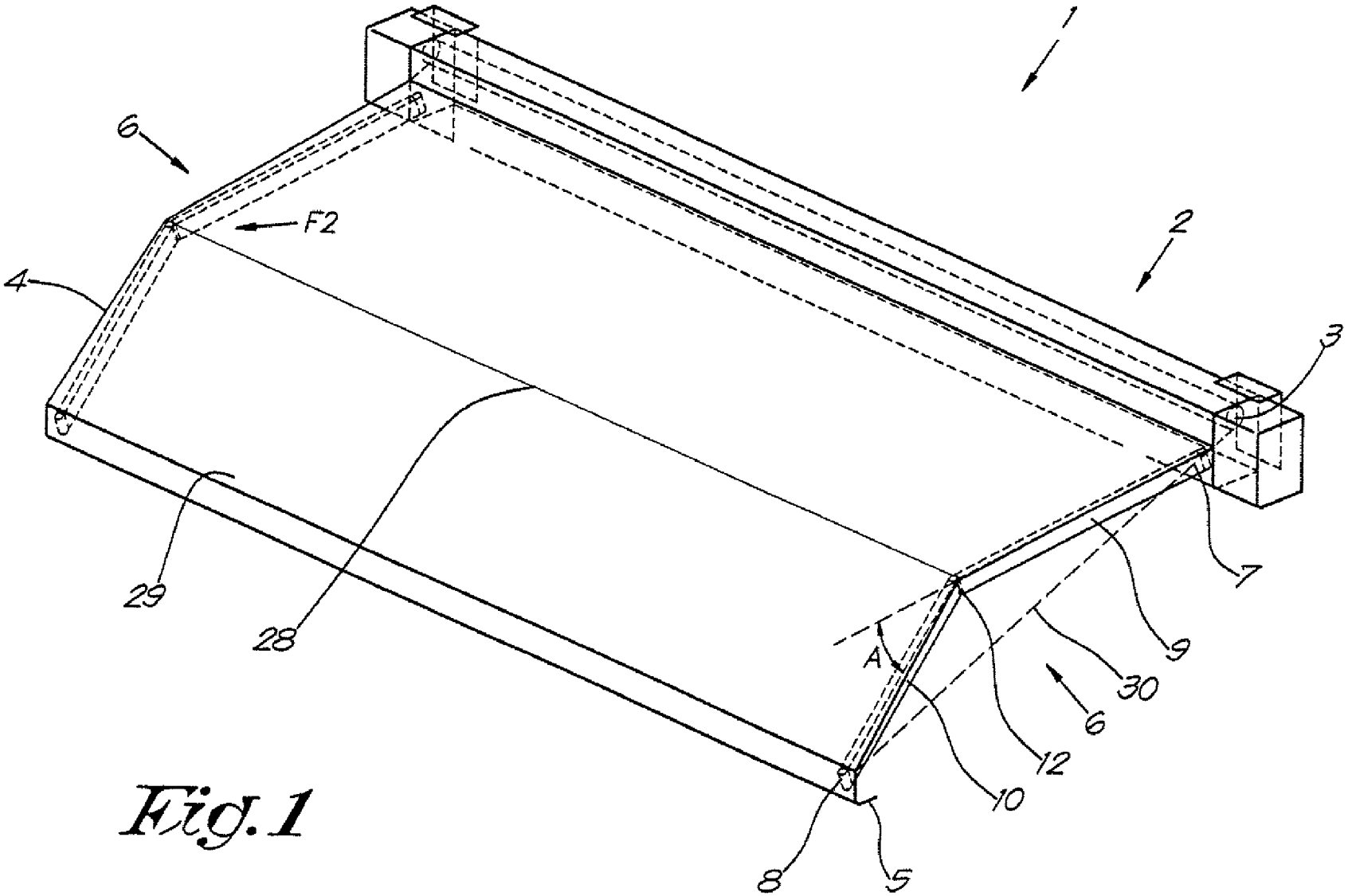
FIG. 1 schematically represents an improved awning according to the invention when unfolded, seen in perspective.

The awning represented in FIG. 1 mainly consists of a casing 2 which is open on the front side and in which is provided a rotating roll-up shaft 3 onto which is fixed a cloth 4 with one edge and whereby the cloth 4 is partly rolled up.

The cloth 4 is fixed with an opposite edge to what is called a front lath 5 which is supported by means of two articulated arms 6, wherein the articulated arms 6 are hinge-mounted to the above-mentioned casing 2 with one far end 7 and wherein the front lath 5 is suspended in a hinged manner to the other far ends 8 of the articulated arms 6.

The articulated arms 6 are in this case each composed of two arm parts, namely an arm part 9 with which the arm 6 is fixed to the awning casing 2, and what is called a front arm 10 onto which the front lath is hung respectively, each formed of a strut, which are hinge-mounted 12 to one another.

As is represented more in detail in FIGS. 2 to 6, the hinge 12 is provided with two coupling elements, namely a first coupling element 13 with which the hinge is fixed to the arm part 9 and a second coupling element 14 with which the hinge is connected to a front arm 10 respectively, and whereby both coupling elements 13 and 14 are hinge-mounted to one another by means of a connecting piece 15 which is hinge-mounted in the first coupling element 13 by means of a first pivot 16 and whereby the second coupling element 14 is hinge-mounted on said connecting piece 15 by means of a second pivot 17.

The first coupling element 13 is provided with two parallel ears 18 and 19 in between which the pivot 16 is fixed.

In the given example, the connecting piece 15 is a bush-shaped element which can rotate round the pivot 16 between the ears 18 and 19, and which is provided with a radially protruding lip 20 on which the second coupling element 14 is hinge-mounted with the pivot 17.

The hinge 12 is provided with a stop 21 which restricts the upward rotational movement around the second pivot 17 of the hinge 12 and which has the shape of a downward protruding rib of an extended part 22 of the upper ear 18, which extended part 22 extends in the prolongation of the first coupling element 13.

The first coupling element 13 further comprises a guide 23 in the shape of a cylindrical bearing surface 24 which is in this case formed of the side edge of the lower ear 19, whereas the second coupling element 14 is provided with a co-operating follower 25 in the shape of a follower wheel 26 which is provided in a freely rotating manner at a distance under the second pivot of the hinge round a spindle 27 directed crosswise to the direction of the second pivot 17.

The cylindrical bearing surface has an axis X-X' which is mainly parallel to the above-mentioned first pivot 16 of the hinge 12, and which is eccentrically shifted in relation to said first pivot 16 in the direction of the first coupling element 13.

The working of the awning 1 according to the invention is very simple and as follows.

Figure 2:
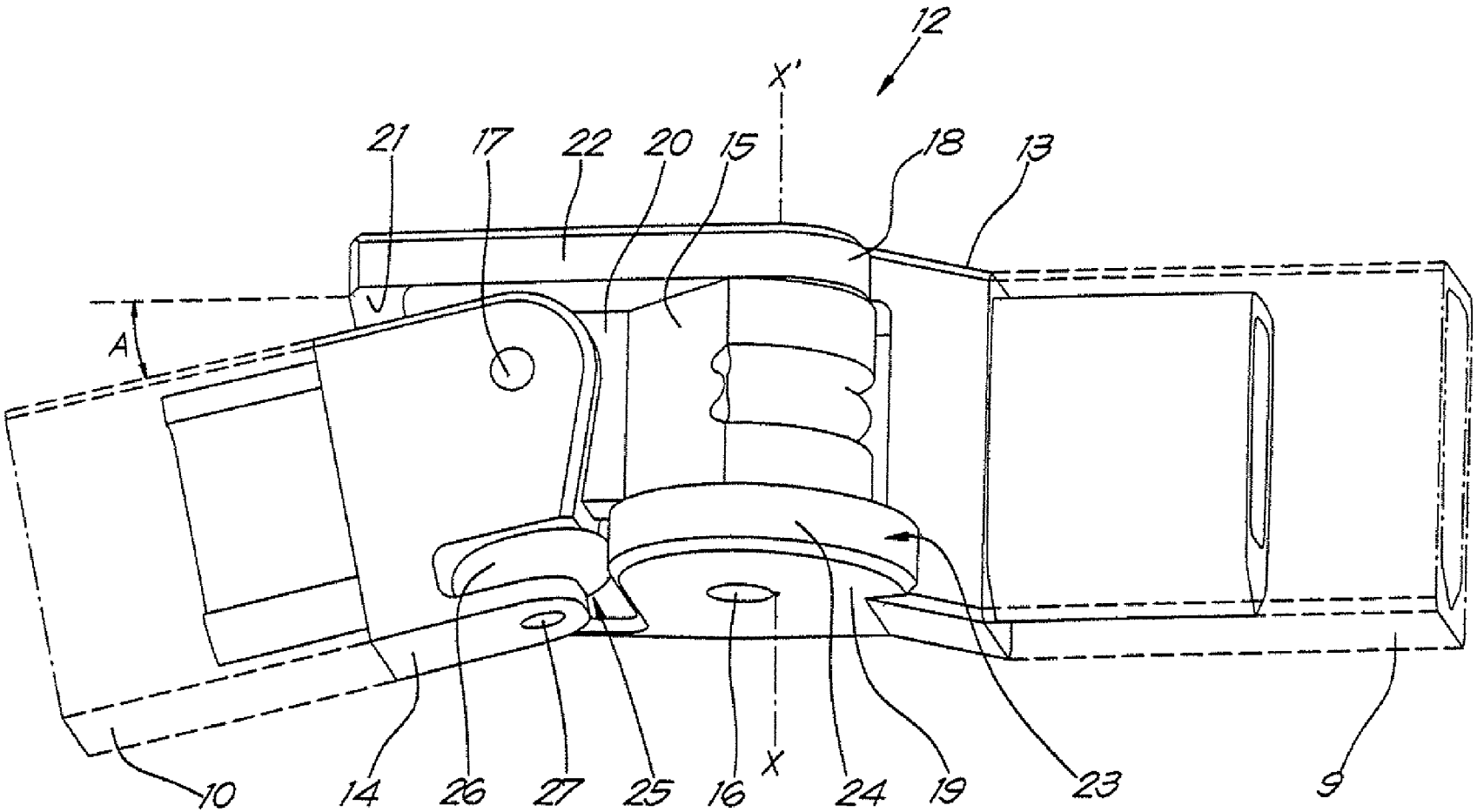
FIG. 2 shows a detail of the part which is indicated by arrow F2 in FIG. 1, and seen in the direction of said arrow.
Figure 5:
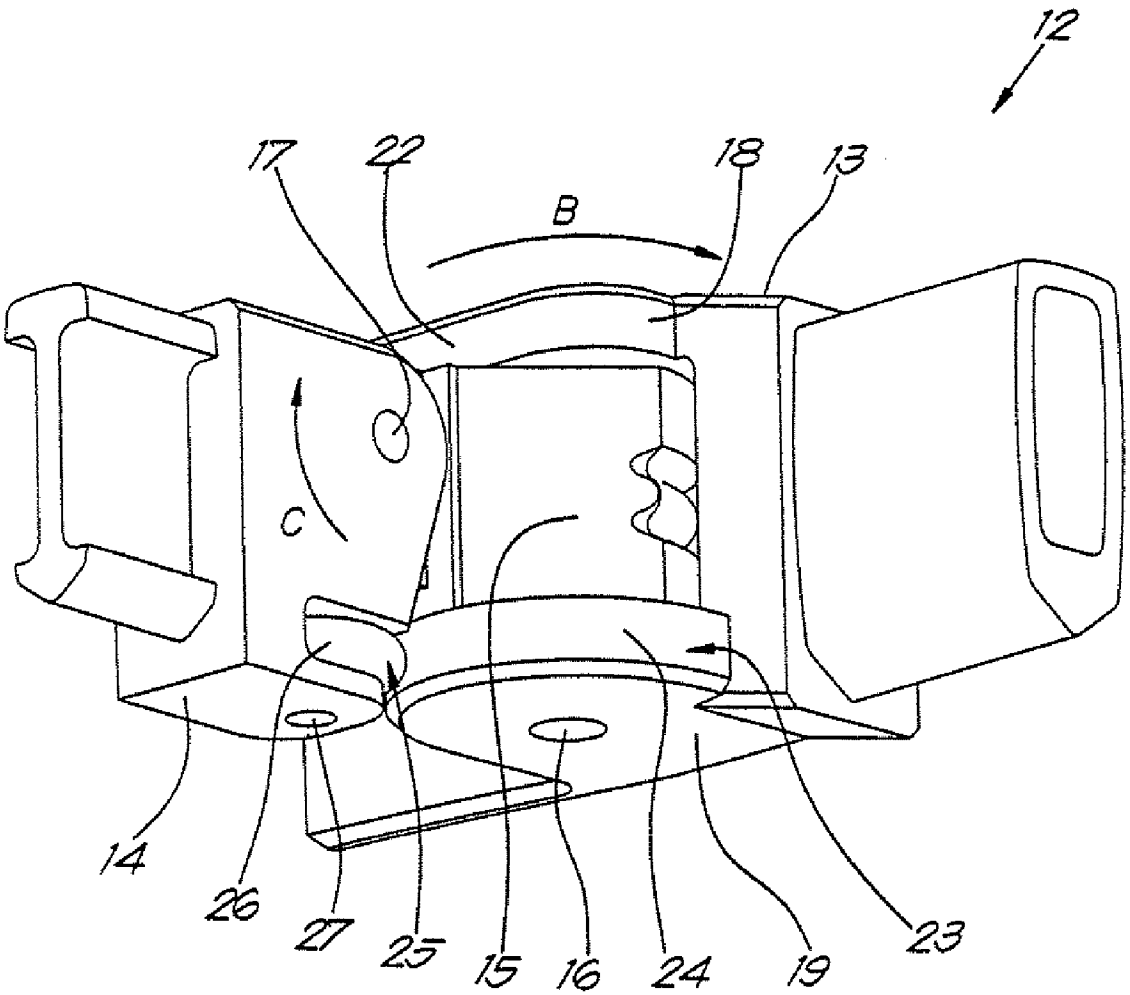
FIG. 5 shows a view according to arrow F5 in FIG. 4.

In the extended position of the awning 1 as represented in FIG. 1, the hinge 12 is in a position as shown in FIG. 2, whereby the front arm 10 assumes a position enclosing a buckling angle A with the arm part 9 with which the articulated arm 6-7 is fixed to the awning casing.

Due to the weight of the front arm 10 and of the front lath 5, the front arm 10 will indeed bend down around the second pivot 17, whereby the front arm 10 is maintained in this position as the second coupling element 14 rests with the follower wheel 16 against the bearing surface 24.

The cloth 4 is held up by the articulated arms 6 and thereby shows a downward slope from the connecting line 28 between the hinges 12 of both arms 6.

In this position, the stop 21 prevents the front arm 10 from revolving upward around the pivot 17. This prevents the bent part 29 of the awning 1 between the above-mentioned connecting line 28 and the front lath 5 from moving up, for example as a result of a gust of wind.

It clear that, in the situation of FIG. 1, there is more free height available under the cloth 4 than in the case of a conventional awning without a slope, as is schematically represented by means of the dashed line 30 which represents the stretching of the cloth 4 in the case of a conventional awning whose articulated arms 6 are equipped with single hinges.

When, starting from the position of the awning 1 corresponding to FIGS. 1 and 2, the cloth 4 is rolled up on the roll-up shaft 3, the front lath 5 will be drawn to the awning casing 2 as a result thereof, such that the arm parts 9-10 will bend inward round the first pivot 16 of the hinge 12.

This rotational movement round the pivot 16 is illustrated by means of arrow B in FIG. 3, which shows a position in which the coupling elements 13-14 are more or less at right angles in relation to one another.

Because of the rotational movement from the position of FIG. 2 into the position of FIG. 3, the front arm 10 is forced to turn automatically up around the second pivot 17, as indicated by the arrow C, as the follower wheel 26 rolls over the bearing surface 24 during this movement and said follower wheel 26 is thus pushed away from the pivot 16 because of the eccentric arrangement of the bearing surface 24 in relation to the first pivot 16.

Figure 4:
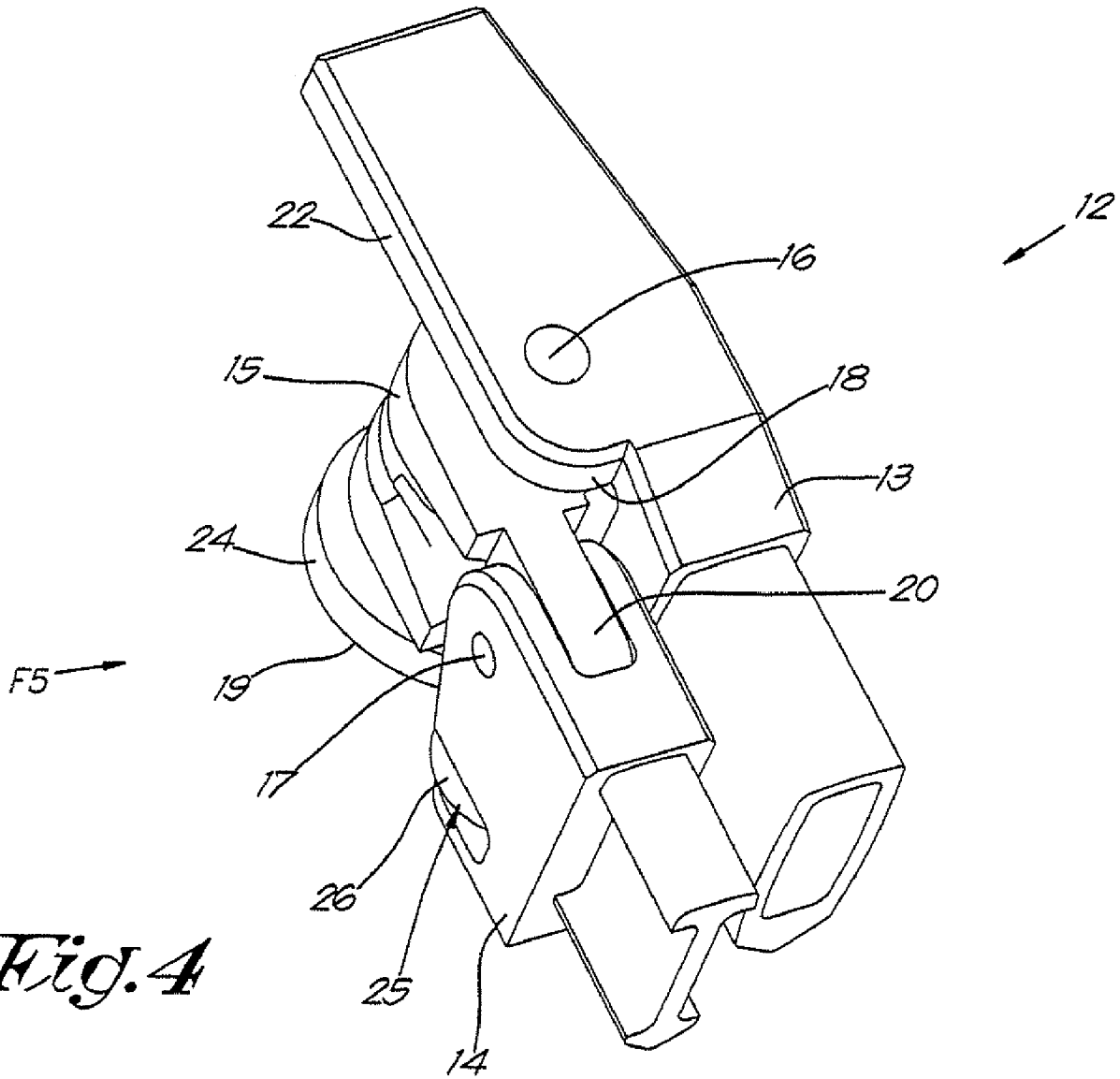
Figure 5:
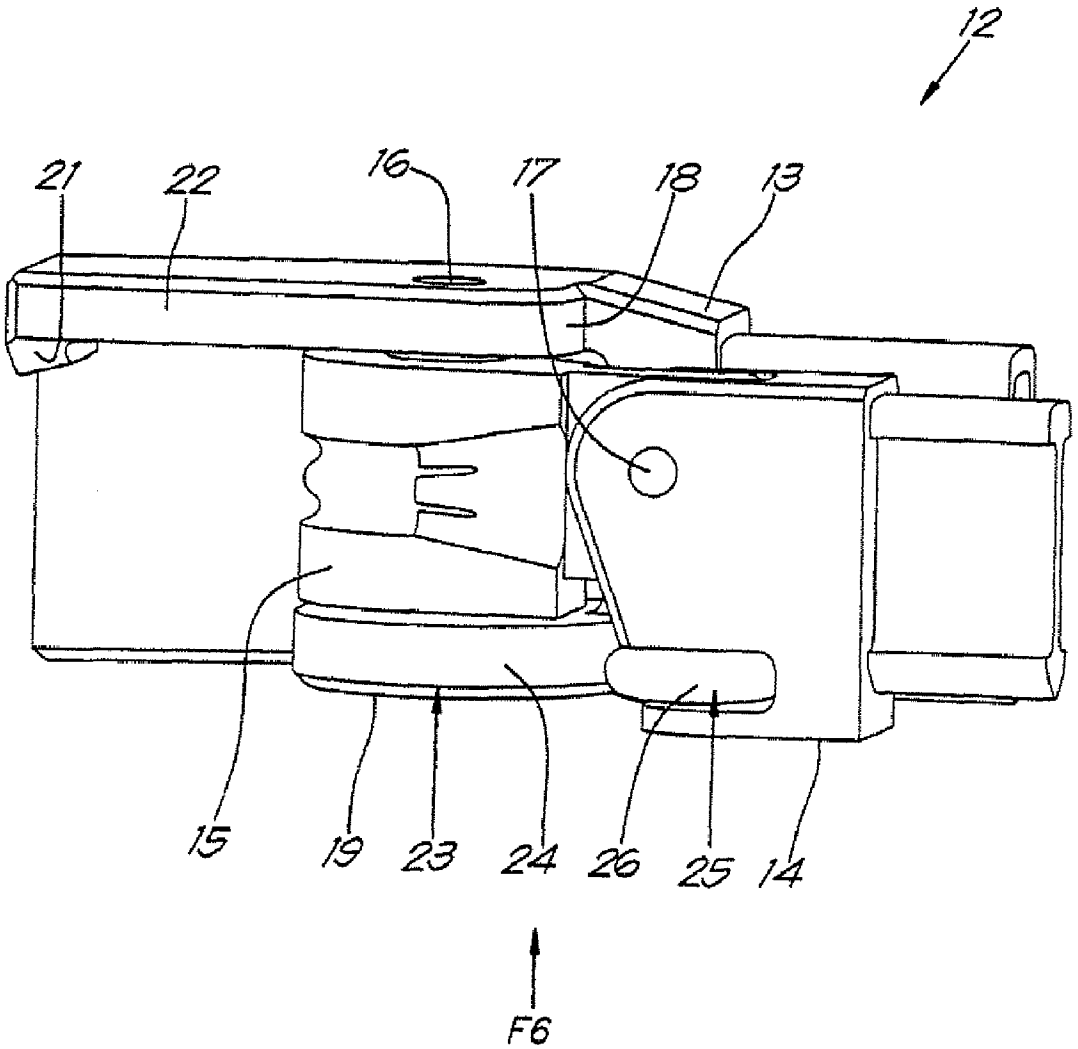
Figure 6:
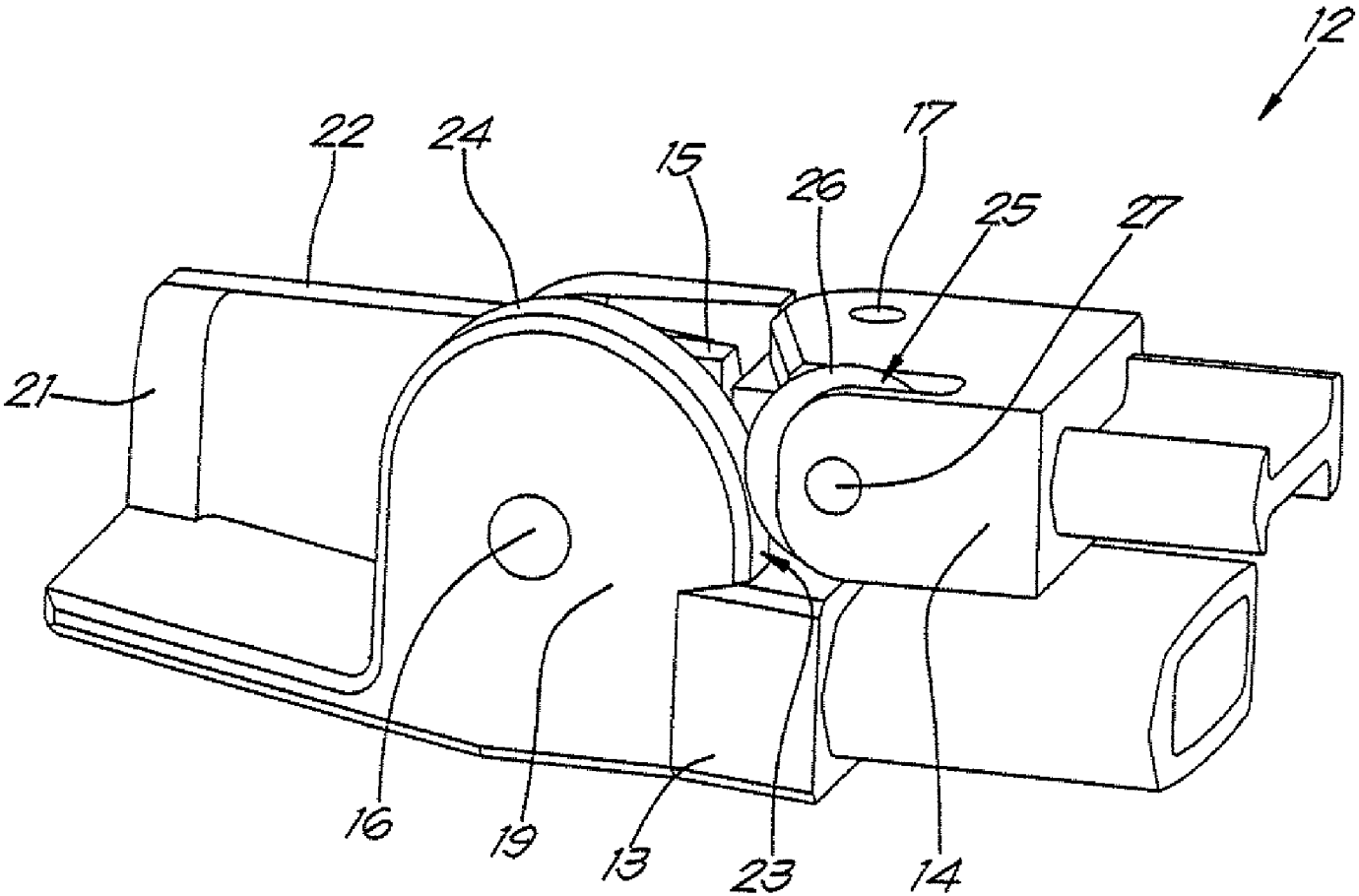
FIG. 6 shows a view according to arrow F6 in FIG. 5.

As the cloth is being rolled up further, the coupling elements arm parts 9-10 and the coupling elements 13-14 that are connected thereto will turn even further towards each other until the articulated arms 6 are folded up entirely or practically entirely, as is illustrated in FIG. 4.

The diameter and the eccentricity of the cylindrical bearing surface 24 are selected such that, in the position of FIG. 4, the arm parts 9-10 are parallel or mainly parallel, such that the folded-up articulated arm 6 assumes a minimal volume in this position, since this position corresponds to the situation in which the awning 1 is rolled up entirely, whereby the front lath 5 covers the opening of the casing 2 and the folded arms 6 are entirely folded up in the casing.

When the cloth 4 is unrolled again, the arm parts 9-10 will move away from one another around the first pivot 16, under the influence of the springs in the articulated arms 6, and the front arm 10 will be automatically lowered round the pivot 17 during said movement, under the influence of the movement of the follower wheel 26 which rolls over the bearing surface 23 and which thus gets constantly closer to the pivot 16.

It is clear that the guide, formed of the bearing surface 24 and the follower wheel 26, in view of the forced movement of the second coupling element 14 around the second pivot 17 when the articulated arm 6 is folded open as of the double-folded position in FIG. 3, can also be realized in other ways, whereby for example the bearing surface must not necessarily be cylindrical but may also have another shape or can be provided in another place.

Figure 7:
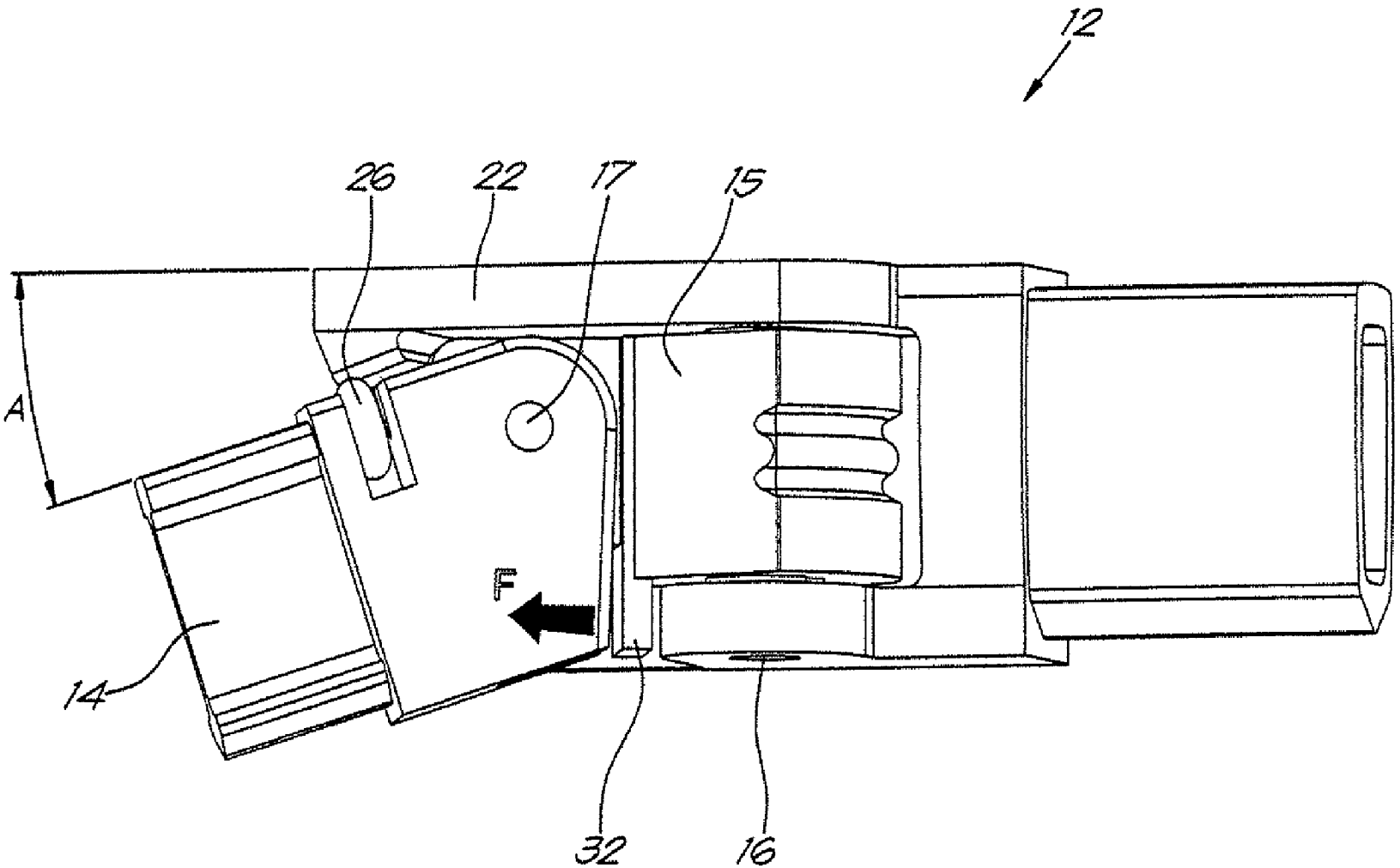
FIG. 7 shows a view as in FIG. 2, but for a variant of an awning according to the invention.
Figure 8:
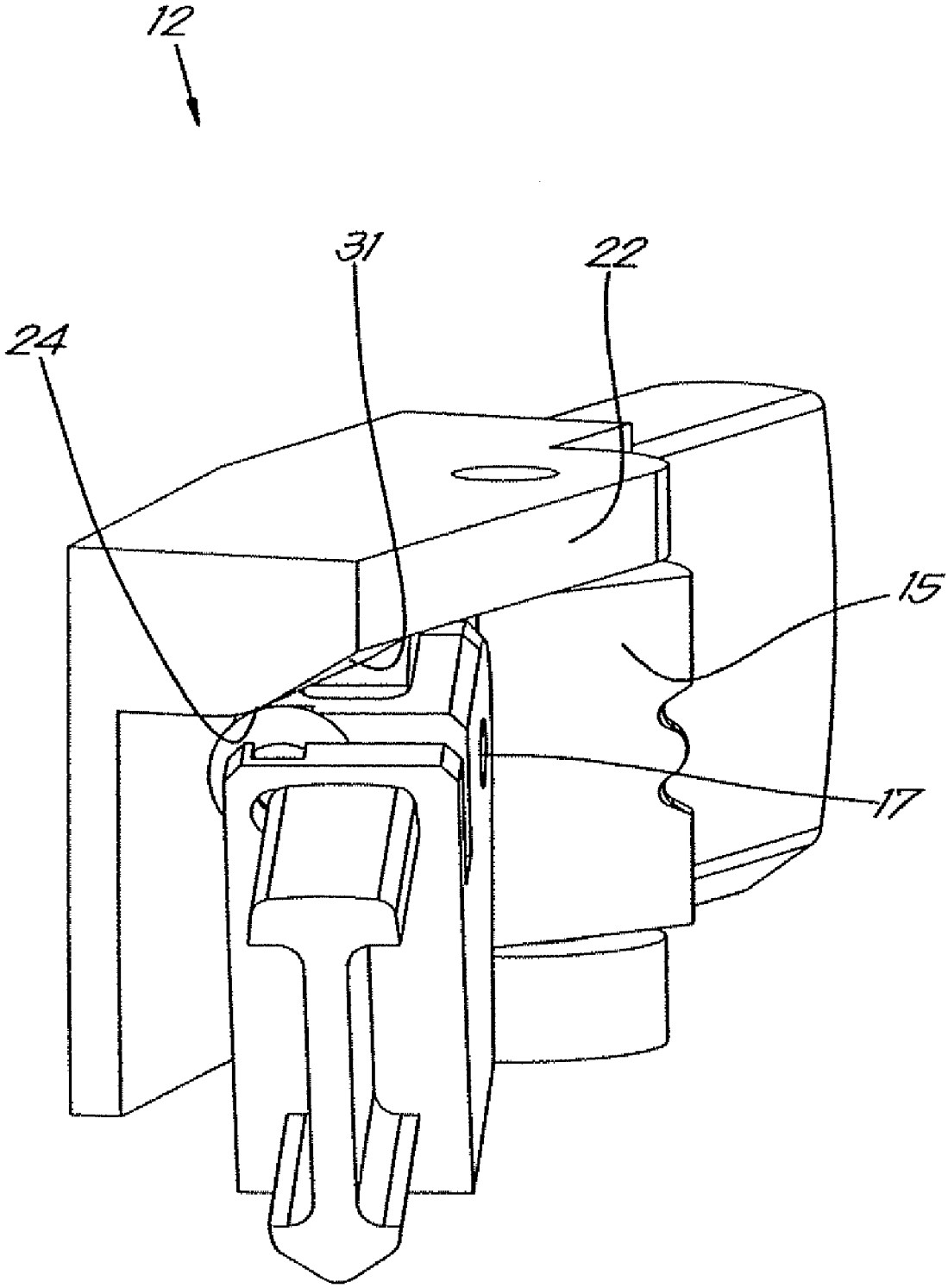
FIG. 8 shows a view according to arrow F8 in FIG. 7.

An example thereof is represented in FIGS. 7 and 8, whereby the guide 23 and the stop 21 are made of one and the same bearing surface 24 on the bottom side of the protruding part 22 and whereby this bearing surface is provided with a slanting surface 31. The follower wheel 26 is thereby provided on the top side of the second coupling element 14 on a shaft which is directed crosswise to the shaft and at a radial distance thereof.

The arm is in this case provided with a spring 32 which tends to exert a force F which makes the second coupling element 14 revolve upward around the pivot 17 and thereby pushes the follower wheel 26 on the bearing surface 24.

Figure 9:
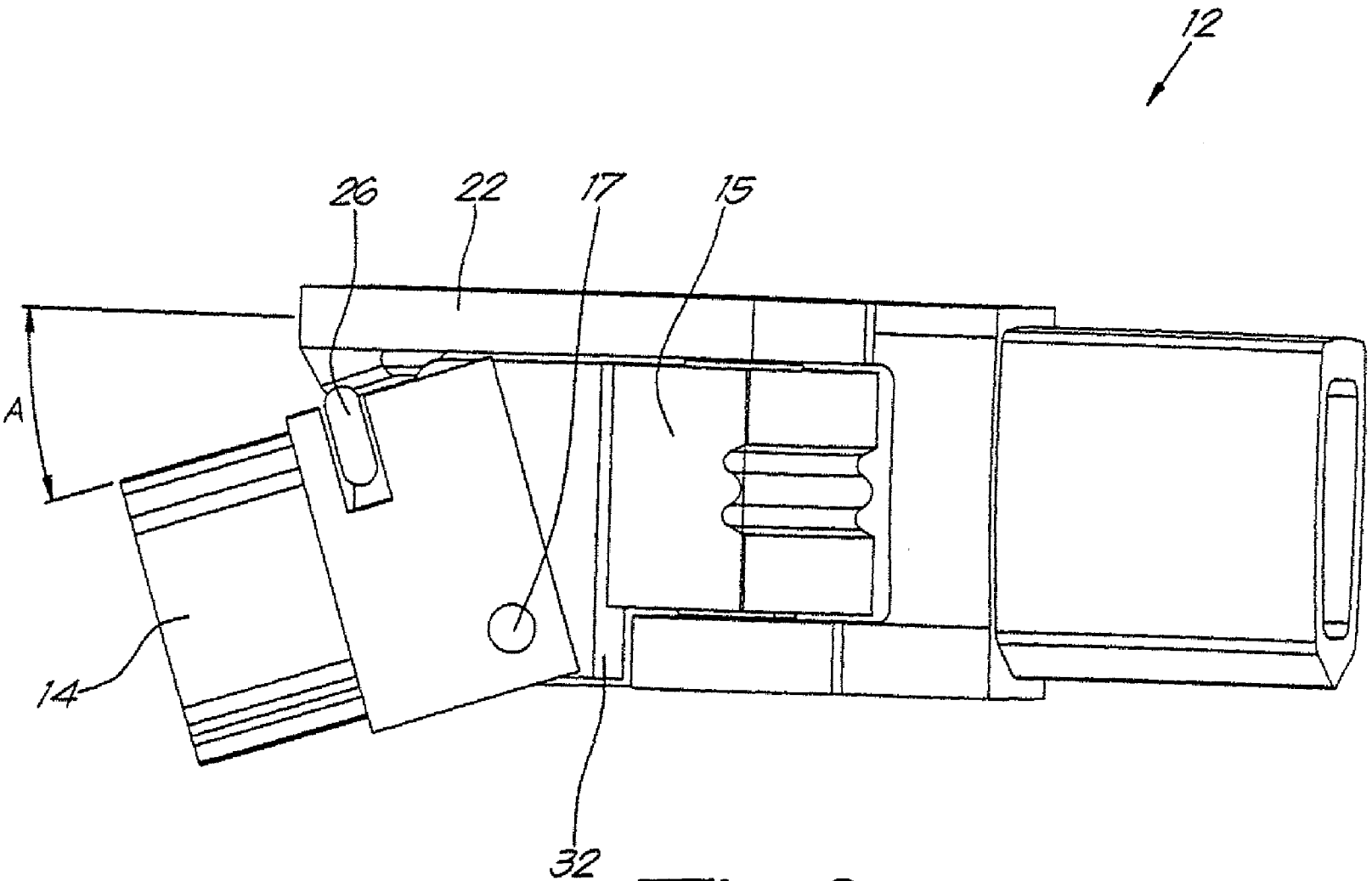
FIG. 9 shows yet another variant.

FIG. 9 shows a variant of the embodiment of FIG. 7, whereby the second pivot 17 is situated on the bottom side of the second coupling element 14 instead of on the top side as in the embodiments which have already been described, but always preferably crosswise to the direction of the first pivot 16.

Moreover, a forced guide is not even strictly necessary, but instead, a manual lock of the rotational movement of the front arm 10 round the second pivot 17 or the like could for example be provided, for example to enable the user to set the buckling angle A as desired as of 0°, corresponding to a neutral situation without any slope, whereby the arm parts 9-10 are situated in each other's prolongation, in an upward as well as in a downward sense of rotation.

Also the stop 23 can be realized in many different ways.

Although a double hinge is described in the above-described example, it is not excluded to provide a multiple hinge 12 with more than two degrees of freedom, such as a ball joint or other possible variants of multiple shafts which allow for at least a rotational movement round two axes of rotation directed mainly crosswise towards one another.

It is clear that the coupling elements 13-14 of the hinge 12 may be integrated in the arm parts 9 and 10.

The present invention is by no means restricted to the embodiment described by way of example and represented in the accompanying drawings; on the contrary, an improved awning according to the invention can be made in all sorts of shapes and dimensions while still remaining within the scope of the invention.

The invention claimed is:

1. Awning comprising a roll-up shaft on which is wound a cloth which is fixed at one edge to a front lath which is supported by two or more articulated arms, each articulated arm comprising at least two arm parts which are connected to each other by a hinge, said hinge defining at least first and second pivot axes which are directed crosswise or mainly crosswise to each other, said hinge comprising a double hinge arranged so as to connect the arm parts in a manner requiring the arm parts to be automatically driven in rotation relative to each other around the second pivot axis during rotation of the arm parts relative each other around the first pivot axis during opening and closing of the awning, said double hinge including a guide and a cooperating follower arrangement causing the automatic rotation.

2. Awning according to claim 1, wherein the double hinge comprises first and second pivots aligned with said first and second axis for enabling said automatic relative rotation around said first and second axis.

3. Awning according to claim 1, wherein the hinge is configured so as to cause a front one of said arm parts to which the front lath is fixed, to automatically pivot down about said second pivot axis over an angle (A) relative to the other arm part to which it is connected by said hinge during opening of the awning.

4. Awning according to claim 1, including a stop arranged to restrict rotational movement around the second pivot axis of the hinge.

5. Awning according to claim 4, wherein the stop comprises a part which extends past the hinge along the prolongation of a first coupling element.

6. Awning according to claim 1, wherein the hinge comprises two coupling elements, including a first coupling element and a second coupling element respectively, by which the hinge is connected to one of the arm parts of the articulated arm, and the coupling elements are connected to one another by a connecting piece which is hinge-mounted in the first coupling element by a first pivot defining the first pivot axis and wherein the second coupling element is hinge-mounted on said connecting piece by a second pivot defining the second pivot axis.

7. Awning according to claim 6, wherein the first coupling element comprises said guide and the second coupling element comprises said follower which cooperates with said guide and with which the second coupling element rests against the first coupling element or is pushed against it, and which forms a guide for driving the movement of the second coupling element around the second pivot axis when the articulated arm parts are opened from a double-bent position.

8. Awning according to claim 7, wherein the guide is configured and arranged such that, when the articulated arm is opened by extending the first and second arm parts relative to each other via the hinge, the second coupling element is driven automatically over a set angle (A) around the second pivot axis.

9. Awning according to claim 7, wherein the guide comprises a cylindrical bearing surface having an axis (X-X') that extends mainly parallel with the first pivot axis and is positioned eccentrically in relation to said first pivot axis.

10. Awning according to claim 7, wherein the first coupling element is provided with two parallel ears, including an upper and lower ear, and in between which the first pivot is fixed and in between which the first connecting piece is rotatable, and wherein the guide comprises a side edge of the lower ear.

11. Awning according to claim 7, including a stop arranged to restrict rotational movement around the second pivot axis of the hinge, and wherein the stop comprises a bearing surface which forms said guide for said follower that is provided on the second coupling element.

12. Awning according to claim 7, wherein the articulated arm is provided with a spring which biases the second coupling element to rotate about the second pivot axis in a direction around the second pivot axis that is upward relative to the first coupling element in its open position.

13. Awning according to claim 7, wherein the follower comprises a follower wheel which is rotatably mounted on a spindle directed crosswise relative to the second pivot of the hinge.

14. Awning according to claim 13, wherein the follower wheel is positioned at a distance from the second pivot of the hinge.

* * * * *